US007859240B1

(12) United States Patent
Geynet et al.

(10) Patent No.: US 7,859,240 B1
(45) Date of Patent: Dec. 28, 2010

(54) CIRCUIT AND METHOD FOR PREVENTING REVERSE CURRENT FLOW INTO A VOLTAGE REGULATOR FROM AN OUTPUT THEREOF

(75) Inventors: Lionel Geynet, Cork (IE); Eugene O'Sullivan, Cork (IE)

(73) Assignee: Cypress Semiconductor Corporation, San Jose, CA (US)

( * ) Notice: Subject to any disclaimer, the term of this patent is extended or adjusted under 35 U.S.C. 154(b) by 375 days.

(21) Appl. No.: 12/009,877

(22) Filed: Jan. 22, 2008

Related U.S. Application Data

(60) Provisional application No. 60/931,216, filed on May 22, 2007.

(51) Int. Cl.
*G05F 1/40* (2006.01)

(52) U.S. Cl. ..... 323/285; 323/280; 307/56

(58) Field of Classification Search ..... 323/222, 323/268, 275, 282–285, 315–316; 307/56, 307/58, 82, 110; 363/49, 59, 60
See application file for complete search history.

(56) References Cited

U.S. PATENT DOCUMENTS

| | | | |
|---|---|---|---|
| 4,158,804 | A | 6/1979 | Butler et al. |
| 4,477,737 | A | 10/1984 | Ulmer et al. |
| 4,689,733 | A | 8/1987 | Guth et al. |
| 4,829,203 | A | 5/1989 | Ashmore, Jr. |
| 4,851,759 | A | 7/1989 | Blauschild |
| 4,866,606 | A | 9/1989 | Kopetz |
| 4,884,161 | A | 11/1989 | Atherton et al. |
| 4,885,719 | A | 12/1989 | Brahmbhatt |
| 4,890,222 | A | 12/1989 | Kirk |
| 4,893,030 | A | 1/1990 | Shearer et al. |
| 4,897,774 | A | 1/1990 | Bingham et al. |
| 4,935,644 | A | 6/1990 | Tsujimoto |
| 5,059,815 | A | 10/1991 | Bill et al. |
| 5,087,834 | A | 2/1992 | Tsay |
| 5,276,646 | A | 1/1994 | Kim et al. |
| 5,280,233 | A | 1/1994 | Poletto et al. |
| 5,311,480 | A | 5/1994 | Schreck |
| 5,319,604 | A | 6/1994 | Imondi et al. |
| 5,371,705 | A | 12/1994 | Nakayama et al. |
| 5,388,249 | A | 2/1995 | Hotta et al. |

(Continued)

OTHER PUBLICATIONS

USPTO Notice of Allowance for U.S. Appl. No. 10/965,445 dated Oct. 26, 2005; 4 pages.

(Continued)

*Primary Examiner*—Rajnikant B Patel

(57) ABSTRACT

A circuit and method are provided for interrupting current flow into a voltage regulator from an output thereof when a voltage source ($V_{pwr}$) drops below an output voltage ($V_{out}$). In one embodiment, the circuit comprises: (i) a comparator supplied by $V_{out}$ including an output and inputs coupled to $V_{pwr}$ and $V_{out}$; and (ii) transistors coupled to and controlled by the comparator, including a first transistor configured to interrupt a first current path extending between $V_{out}$ and $V_{pwr}$ through an output-leg of the regulator when $V_{pwr}$ drops below $V_{out}$. Preferably, the regulator includes a reference-leg and a feedback-circuit coupling $V_{out}$ thereto, and the first transistor also interrupts a second current path between $V_{out}$ and $V_{pwr}$ through the feedback-circuit and reference leg. More preferably, the reference-leg comprises resistors through which it is coupled to ground, and the transistors include a second transistor to interrupt a third current path between $V_{out}$ and ground.

20 Claims, 4 Drawing Sheets

U.S. PATENT DOCUMENTS 5,392,421 A 2/1995 Lennartsson
5,402,394 A 3/1995 Turski
5,438,542 A 8/1995 Atsumi et al.
5,461,557 A 10/1995 Tamagawa
5,461,723 A 10/1995 Shah et al.
5,570,043 A 10/1996 Churchill
5,587,603 A 12/1996 Kowshik
5,592,430 A 1/1997 Ohtsuki
5,600,551 A 2/1997 Luscher, Jr.
5,621,902 A 4/1997 Cases et al.
5,628,001 A 5/1997 Cepuran
5,630,147 A 5/1997 Datta et al.
5,635,872 A 6/1997 Zimmerman
5,637,992 A 6/1997 Edwards
5,642,489 A 6/1997 Bland et al.
5,666,069 A 9/1997 Gibbs
5,675,813 A 10/1997 Holmdahl
5,691,654 A 11/1997 Green et al.
5,701,272 A 12/1997 Brennan, Jr.
5,740,106 A 4/1998 Nazarian
5,748,911 A 5/1998 Maguire et al.
5,748,923 A 5/1998 Eitrich
5,754,799 A 5/1998 Hiles
5,757,228 A 5/1998 Furutani
5,761,058 A 6/1998 Kanda et al.
5,767,735 A 6/1998 Javanifard et al.
5,767,844 A 6/1998 Stoye
5,774,744 A 6/1998 Story et al.
5,778,218 A 7/1998 Gulick
5,781,028 A 7/1998 Decuir
5,796,656 A 8/1998 Kowshik et al.
5,812,459 A 9/1998 Atsumi et al.
5,841,696 A 11/1998 Chen et al.
5,847,993 A 12/1998 Dejenfelt
5,852,370 A 12/1998 Ko
5,867,013 A 2/1999 Yu
5,871,368 A 2/1999 Erdner et al.
5,884,086 A 3/1999 Amoni et al.
5,889,664 A 3/1999 Oh
5,929,692 A 7/1999 Carsten
5,938,770 A 8/1999 Kim
5,982,158 A 11/1999 Schnars et al.
6,025,701 A 2/2000 Weinhold
6,094,095 A 7/2000 Murray et al.
6,105,097 A 8/2000 Larky et al.
6,118,676 A 9/2000 Divan et al.
6,144,580 A 11/2000 Murray
6,157,176 A 12/2000 Pulvirenti et al.
6,157,178 A 12/2000 Montanari
6,222,353 B1 4/2001 Pattamatta et al.
6,232,757 B1 5/2001 Afghahi et al.
6,373,231 B1 4/2002 Lacey et al.
6,522,111 B2 2/2003 Zadeh et al.
6,566,851 B1 5/2003 Schuelke et al.
6,661,214 B1 12/2003 Hann et al.
6,879,142 B2 4/2005 Chen
7,026,802 B2 4/2006 Gradinarlu

OTHER PUBLICATIONS

USPTO Non-Final Rejection for U.S. Appl. No. 10/965,445 dated May 3, 2005; 5 pages.
USPTO Notice of Allowance for U.S. Appl. No. 09/106,808 dated Mar. 21, 2000; 5 pages.
USPTO Final Rejection for Application No. 09/106,808 dated Dec. 3, 1999; 10 pages.
USPTO Non-Final Rejection for Application No. 09/106,808 dated Jun. 24, 1999; 8 pages.
USPTO Notice of Allowance for Application No. 09/276,321 dated Jun. 12, 2000; 1 page.
USPTO Non-Final Rejection for Application No. 09/276,321 dated Feb. 4, 2000; 3 pages.
USPTO Notice of Allowance for Application No. 09/456,801 dated Jun. 6, 2000; 3 pages.
USPTO Notice of Allowance for Application No. 09/172,956 dated Apr. 6, 2000; 3 pages.
USPTO Non-Final Rejection for Application No. 09/172,956 dated Dec. 20, 1999; 6 pages.
USPTO Notice of Allowance for Application No. 08/974,436 dated Aug. 3, 1998; 2 pages.
USPTO Non-Final Rejection for Application No. 08/974,436 dated Apr. 30, 1998; 4 pages.
USPTO Notice of Allowance for Application No. 08/577,258 dated Apr. 24, 1997; 2 pages.
USPTO Non-Final Rejection for Application No. 08/577,258 dated Aug. 30, 1996; 11 pages.
USPTO Notice of Allowance for U.S. Appl. No. 08/381,125 dated May 1, 1996; 1 page.
USPTO Non-Final Rejection for U.S. Appl. No. 08/381,125 dated Nov. 2, 1995; 5 pages.
USPTO Non-Final Rejection for U.S. Appl. No. 08/381,125 dated Jul. 11, 1995; 4 pages.
USPTO Notice of Allowance for U.S. Appl. No. 08/572,618 dated Apr. 25, 1997; 1 page.
USPTO Non-Final Rejection for U.S. Appl. No. 08/572,618 dated Sep. 18, 1996; 3 pages.
USPTO Notice of Allowance for U.S. Appl. No. 09/730,315 dated Nov. 20, 2001; 4 pages.
USPTO Non-Final Rejection for U.S. Appl. No. 09/730,315 dated May 23, 2001; 4 pages.

CIRCUIT AND METHOD FOR PREVENTING REVERSE CURRENT FLOW INTO A VOLTAGE REGULATOR FROM AN OUTPUT THEREOF

CROSS-REFERENCE TO RELATED APPLICATIONS

The present application claims the benefit of priority under 35 U.S.C. 119(e) to U.S. Provisional Patent Application Ser. No. 60/931,216 entitled "A Replica Transistor Voltage Regulator Architecture," filed May 22, 2007, which application is hereby incorporated by reference in its entirety.

TECHNICAL FIELD

The present invention relates generally to voltage regulators, and more particularly to a circuit and method to substantially prevent or interrupt reverse current flow into a voltage regulator from an output thereof.

BACKGROUND OF THE INVENTION

Voltage regulator circuits or voltage regulators are widely used in many applications to provide a nearly constant output voltage at a desired level that is substantially independent of a poorly specified and often fluctuating input voltage and output conditions (i.e., variation in a load current).

One type of voltage regulator is a replica voltage regulator. In a replica voltage regulator a voltage established in one portion or one leg of a circuit is replicated in another leg or portion of the circuit, typically by larger sized devices, to provide a desired load or output voltage. The output voltage is regulated by having it track the voltage in the first leg or portion as closely as possible.

An example of an output stage of a replica voltage regulator architecture for which a circuit and method of the present invention is particularly useful is shown in FIG. 1. Referring to FIG. 1A, the voltage regulator 100 includes a reference leg 102 coupled between a voltage source ($V_{pwr}$) and ground 104, and an output leg 106 coupled between $V_{pwr}$ and an output node ($V_{out}$). The reference leg 102 includes a first transistor 108 connected as a source follower (SF) and including a gate node ($V_{gate}$) coupled to and controlled by for example an operational amplifier or a charge pump (not shown) in the voltage regulator 100, and an output node ($V_{source}$) coupled to ground 104 through a series resistor network 110. The output leg 106 includes a second larger transistor 112, also connected as a source follower and controlled by the gate node ($V_{gate}$) of the first transistor 108. The voltage regulator 100 further includes a small feedback resistor ($R_f$ 114) coupling the output nodes of the first transistor 108 ($V_{source}$) and the second transistor 112 ($V_{out}$) to improve the accuracy and stability of the regulator. The first and the second transistors 108, 112 are selected so that the output voltage $V_{out}$ is a replica of the $V_{source}$ voltage. A ratio between resistors $R_1$ and $R_2$ in the series resistor network 110 is selected so that $V_{source}$ is equal to the desired target voltage—that is it is the same as the desired $V_{out}$.

In normal operation $V_{pwr}$ is greater than $V_{out}$ and current flows through the reference leg 102, indicated by arrows 116, generating the desired target voltage at the output node of the first transistor 108 ($V_{source}$), which is then replicated at the output node of the second transistor 112 ($V_{out}$). Current, indicated by arrows 118 and 120, flows from the sources ($V_{source}$ and $V_{out}$) of the first and the second transistors 108, 112 to the output node ($V_{out}$) of the voltage regulator 100.

Although the above described circuit provides a simple architecture that occupies a small area on a silicon die or substrate, it is not wholly satisfactory for a number of reasons. In particular, referring to FIG. 1B, when $V_{pwr}$ goes lower than the output voltage ($V_{out}$) of the voltage regulator 100, the source potential ($V_{source}$ and $V_{out}$) of the first and the second transistors 108, 112 becomes higher than the drain potential ($V_{pwr}$) causing reverse currents, indicated by arrows 122 and 124, to flow from the source to the drain of the source follower transistors. Yet another leakage path allows a reverse current, indicated by arrow 126, to flow from $V_{out}$ through the feedback resistor ($R_f$) 114 and the resistor network 110. The sum of these reverse currents can be substantial, on the order of several milliamps (mA), and can induce a drop or droop in the output voltage ($V_{out}$) and will quickly discharge batteries in battery operated devices.

Accordingly, there is a need for a circuit and method that substantially prevents or interrupts a reverse current flow into a voltage regulator and the resultant droop in output voltage when a voltage of the voltage source ($V_{pwr}$) drops below a voltage at the output of the voltage regulator ($V_{out}$). It is further desirable that the circuit and method substantially not effect performance of the voltage regulator under normal operating conditions, i.e., when $V_{pwr}$ is greater than $V_{out}$.

SUMMARY OF THE INVENTION

The present invention provides a solution to these and other problems, and offers further advantages over conventional voltage regulators and methods of operating the same.

In one aspect, the present invention is directed to a circuit for interrupting current flow into a voltage regulator from an output of the voltage regulator. The circuit comprises: (i) a comparator including an output, an input coupled to a voltage source, and an input coupled to the output of the voltage regulator; and (ii) a number of transistors coupled to the output of the comparator and controlled thereby. Generally, the number of transistors include a first transistor configured to interrupt a first current path extending between the output of the voltage regulator and the voltage source through an output leg of the voltage regulator when a voltage of the voltage source ($V_{pwr}$) drops below a voltage at the output of the voltage regulator ($V_{out}$). The comparator is powered by the output of the voltage regulator ($V_{out}$) rather than the voltage source ($V_{pwr}$) to avoid a varying or dropping $V_{pwr}$ from adversely effecting operation of the comparator.

Preferably, the voltage regulator is a replica voltage regulator further including a reference leg and a feedback circuit coupling $V_{out}$ to the reference leg, and the first transistor is also configured to interrupt a second current path extending between the output of the voltage regulator and the voltage source through the feedback circuit and at least partially through reference leg. More preferably, the reference leg further includes a resistor network through which the feedback circuit is coupled to a circuit ground, and the number of transistors include a second transistor configured to interrupt a third current path extending between the output of the voltage regulator and circuit ground through the feedback circuit and the resistor network when $V_{pwr}$ drops below $V_{out}$.

In certain embodiments, the output leg includes a first source follower (SF) transistor in the first current path and the reference leg includes a second SF transistor in the second current path, and the first transistor is configured to pull gate nodes of the first and second SF transistors to a circuit ground when $V_{pwr}$ drops below $V_{out}$.

In other embodiments, the comparator is also configured to signal a device comprising or coupled to the voltage regulator when $V_{pwr}$ drops below $V_{out}$.

In another aspect, the present invention is directed to a method of operating a voltage regulator to interrupt current flow into the voltage regulator from an output thereof. Generally, the method including steps of: (i) a comparing $V_{pwr}$ of a voltage source coupled to the voltage regulator to $V_{out}$ at the output of the voltage regulator; and (ii) controlling a number of transistors to substantially prevent current from flowing from the output of the voltage regulator into the voltage regulator when $V_{pwr}$ drops below $V_{out}$. Preferably, the voltage regulator is a replica voltage regulator comprising a reference leg and an output leg, and the method includes the step of interrupting a first current path extending between the output of the voltage regulator and the voltage source through an output leg of the voltage regulator when $V_{pwr}$ drops below $V_{out}$. More preferably, the voltage regulator further comprises a feedback circuit coupling $V_{out}$ to the reference leg, and wherein the method further includes the step of interrupting a second current path extending between the output of the voltage regulator and the voltage source through the feedback circuit and at least partially through reference leg when $V_{pwr}$ drops below $V_{out}$.

In certain embodiments, the output leg comprises a first SF transistor in the first current path and the reference leg comprises a second SF transistor in the first current path, and the steps of interrupting the first and second current paths include the steps of pulling gate nodes of the first and second SF transistors to a circuit ground when $V_{pwr}$ drops below $V_{out}$. Preferably, the reference leg further comprises a resistor network through which the feedback circuit is coupled to circuit ground, and the method further includes the step of interrupting a third current path extending between the output of the voltage regulator and circuit ground through the feedback circuit and the resistor network when $V_{pwr}$ drops below $V_{out}$.

In other embodiments, the method can further include the step of signaling a device comprising or coupled to the voltage regulator when $V_{pwr}$ drops below $V_{out}$.

BRIEF DESCRIPTION OF THE DRAWINGS

These and various other features and advantages of the present invention will be apparent upon reading of the following detailed description in conjunction with the accompanying drawings and the appended claims provided below, where:

DETAILED DESCRIPTION

The present invention is directed to a circuit and method for interrupting or substantially preventing reverse current flow into an output of a voltage regulator when a voltage of a voltage source of the voltage regulator drops below a voltage at the output of the voltage regulator.

The voltage regulator and method of the present invention are particularly useful in battery operated devices, such as a wireless computer mouse and other like devices, which include integrated voltage regulators.

In the following description, for purposes of explanation, numerous specific details are set forth in order to provide a thorough understanding of the present invention. It will be evident, however, to one skilled in the art that the present invention may be practiced without these specific details. In other instances, well-known structures, and techniques are not shown in detail or are shown in block diagram form in order to avoid unnecessarily obscuring an understanding of this description.

Reference in the description to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The term "to couple" as used herein may include both to directly connect and to indirectly connect through one or more intervening components.

Briefly, the circuit of the present invention includes a comparator including an output, an input coupled to a voltage source, and an input coupled to the output of the voltage regulator, and a number of transistors coupled to the output of the comparator to interrupt or substantially prevent current from flowing from the output of the voltage regulator into the voltage regulator when a voltage of a voltage source ($V_{pwr}$) of the voltage regulator drops below a voltage at the output of the voltage regulator ($V_{out}$).

The circuit and methods for operating the same according to various embodiments of the present invention will now be described in detail with reference to FIG. 2.

Figure 1A:
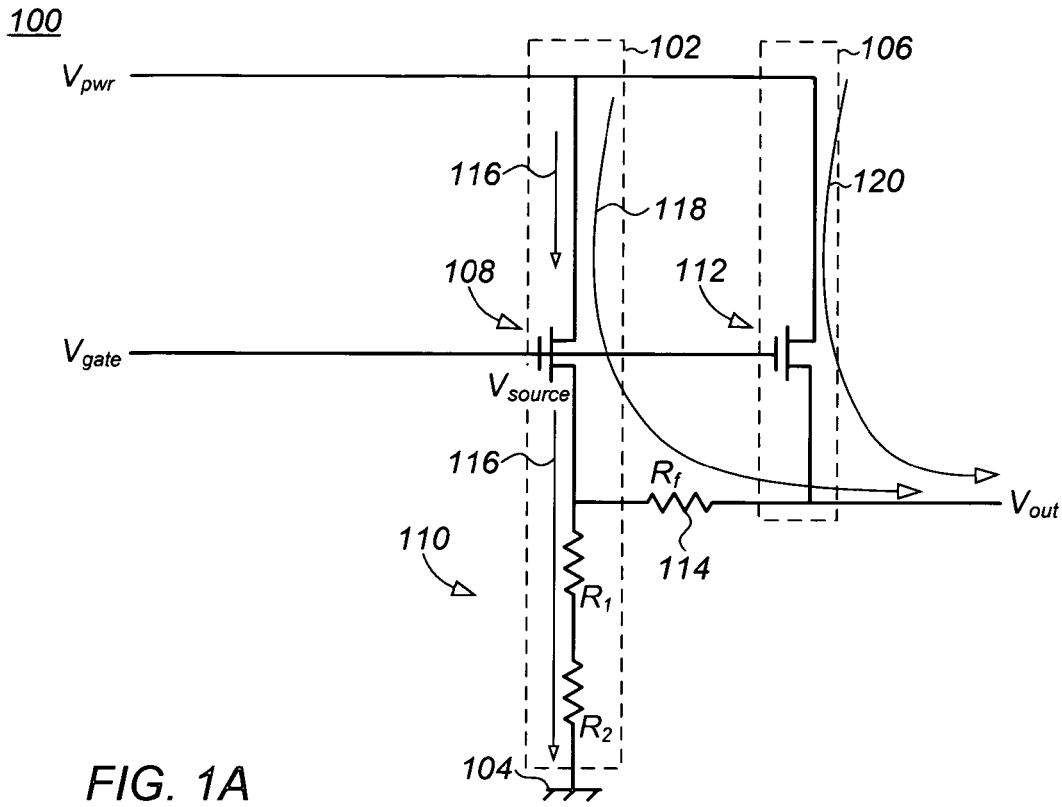
FIG. 1A is a simplified schematic diagram illustrating current flow in an output stage of a voltage regulator when a power supply is greater than the output voltage for which a circuit and method of the present invention is particularly useful.
Figure 1B:
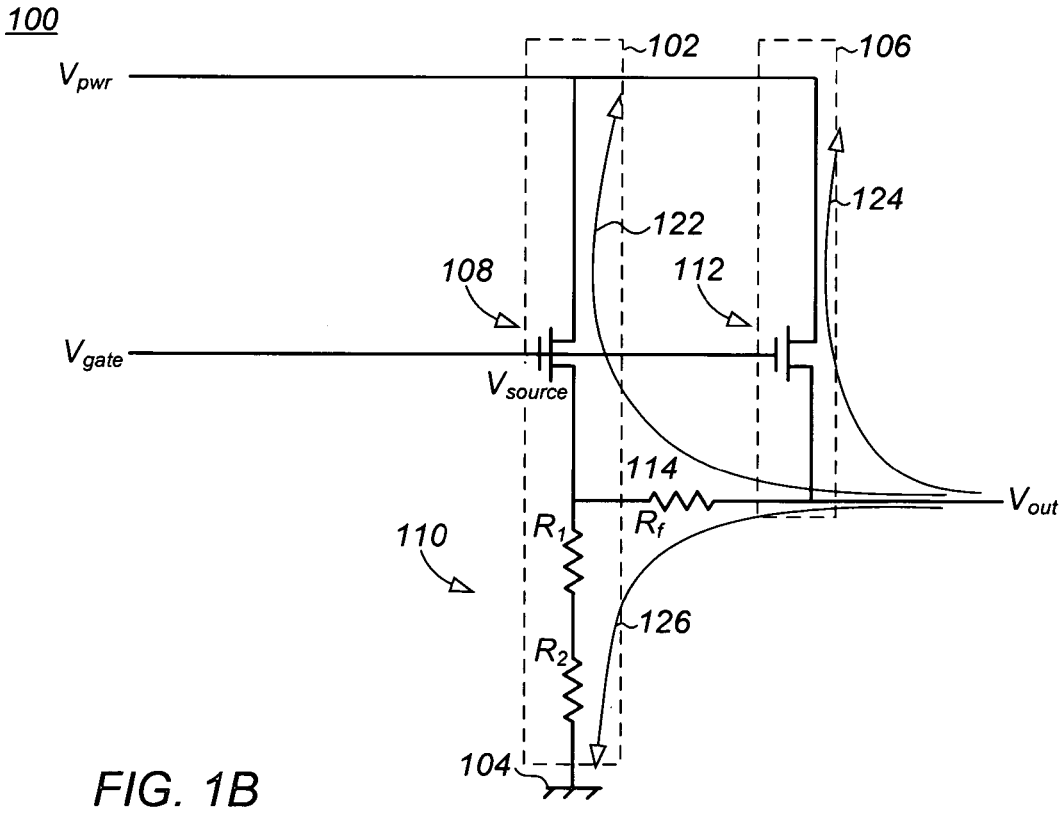
FIG. 1B is a simplified schematic diagram of the voltage regulator of FIG. 1A illustrating current flow into the voltage regulator when a power supply voltage drops below an output voltage.
Figure 2:
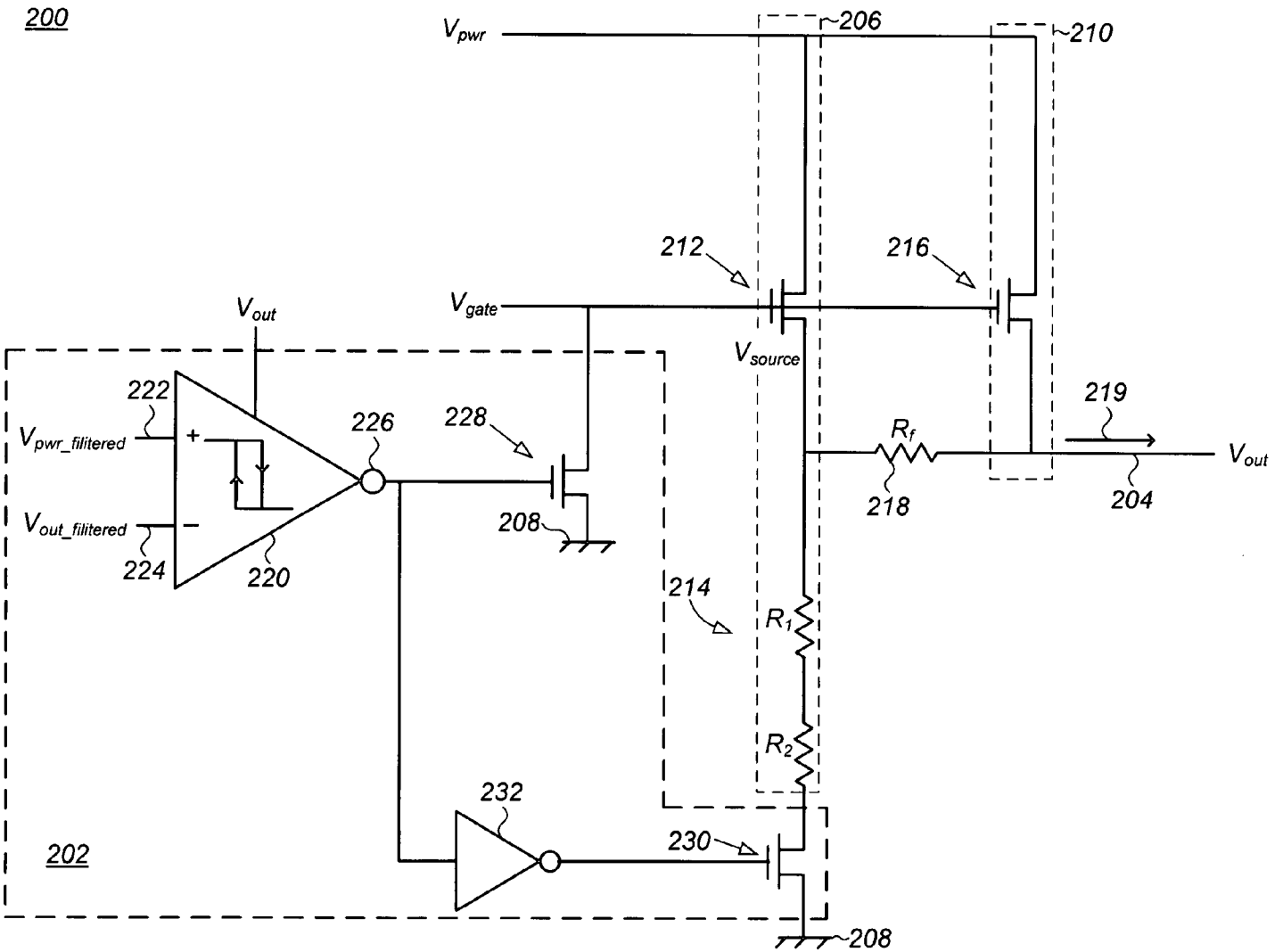
FIG. 2 is a schematic diagram an output stage of a voltage regulator including a circuit to substantially prevent or interrupt reverse current flow into the voltage regulator from an output thereof according to an embodiment of the present invention.

FIG. 2 shows a schematic view of an output stage of a voltage regulator 200 including an interrupt circuit or circuit 202 for interrupting or substantially preventing reverse current flow into an output 204 of the regulator when $V_{pwr}$ drops below $V_{out}$ according to an embodiment of the present invention. For purposes of clarity, many of the details of integrated circuit (IC) design in general and voltage regulators in particular that are widely known and are not relevant to the present invention have been omitted from the following description.

In the embodiment shown the voltage regulator 200 is a replica type voltage regulator and includes a reference leg 206 coupled between $V_{pwr}$ and ground 208, and an output leg 210 coupled between $V_{pwr}$ and the output node 204. The reference leg 206 includes a first transistor 212 connected as a source follower (SF) and including a gate node ($V_{gate}$) coupled to and controlled by an operational amplifier (OPAMP) or a charge pump and an output node ($V_{source}$) coupled to ground 208 through a series resistor network 214. The output leg 210 includes a second larger transistor 216, also connected as a source follower and controlled by the gate node ($V_{gate}$) of the first transistor 212. The voltage regulator 200 further includes a small a feedback resistor ($R_f$ 218) coupling the output nodes of the first transistor 212 ($V_{source}$) and the second transistor 216 ($V_{out}$) to improve the accuracy and stability of the regulator. The first and the second transistors 212, 216 are selected so that the output voltage $V_{out}$ is a replica of the $V_{source}$ voltage. A ratio between resistors $R_1$ and $R_2$ in the series resistor network 214 is selected so that $V_{source}$ is equal to the desired target voltage—that is it is the same as the desired $V_{out}$. In normal operation current, indicated by arrow 219, flows from the sources of the first and the second transistors 212, 216 to the output node 204 of the voltage regulator 200.

Referring to FIG. 2 in one embodiment the interrupt circuit 202 comprises a comparator 220 powered by the output node 204 ($V_{out}$) and including a non-inverting input 222 coupled to a filtered voltage from the voltage source ($V_{pwr_filtered}$) and an inverting input 224 coupled to a filtered voltage from the output of the voltage regulator ($V_{out_filtered}$). By filtered voltage it is meant the voltage is processed to attenuate or remove completely in unwanted variation or ripple in the voltage applied to the filter. Filtering can be accomplished by any known filter circuit (not shown) including, for example, an active or passive filter, such as a RC-filter. The comparator 220 further includes an output 226 coupled to a number of transistors configured or adapted to substantially prevent current from flowing from the output 204 into the voltage regulator 200 when $V_{pwr}$ drops below $V_{out}$.

The number of transistors include a first transistor 228 configured to interrupt a first and second current paths extending between the output 204 of the voltage regulator 200 and the voltage source through the reference leg 206 and output leg 210 when $V_{pwr}$ drops below $V_{out}$. Preferably, as in the embodiment shown, the first transistor is a leaker transistor configured to pull gate nodes of the first and second SF transistors 212, 216 to ground 208 when $V_{pwr}$ drops below $V_{out}$. More preferably, the number of transistors include an inverter 232 and a second, normally closed switching transistor 230 configured to interrupt a third current path extending between the output 204 of the voltage regulator 200 and circuit ground through the feedback resistor 218 and the resistor network 214 when $V_{pwr}$ drops below $V_{out}$.

Figure 3:
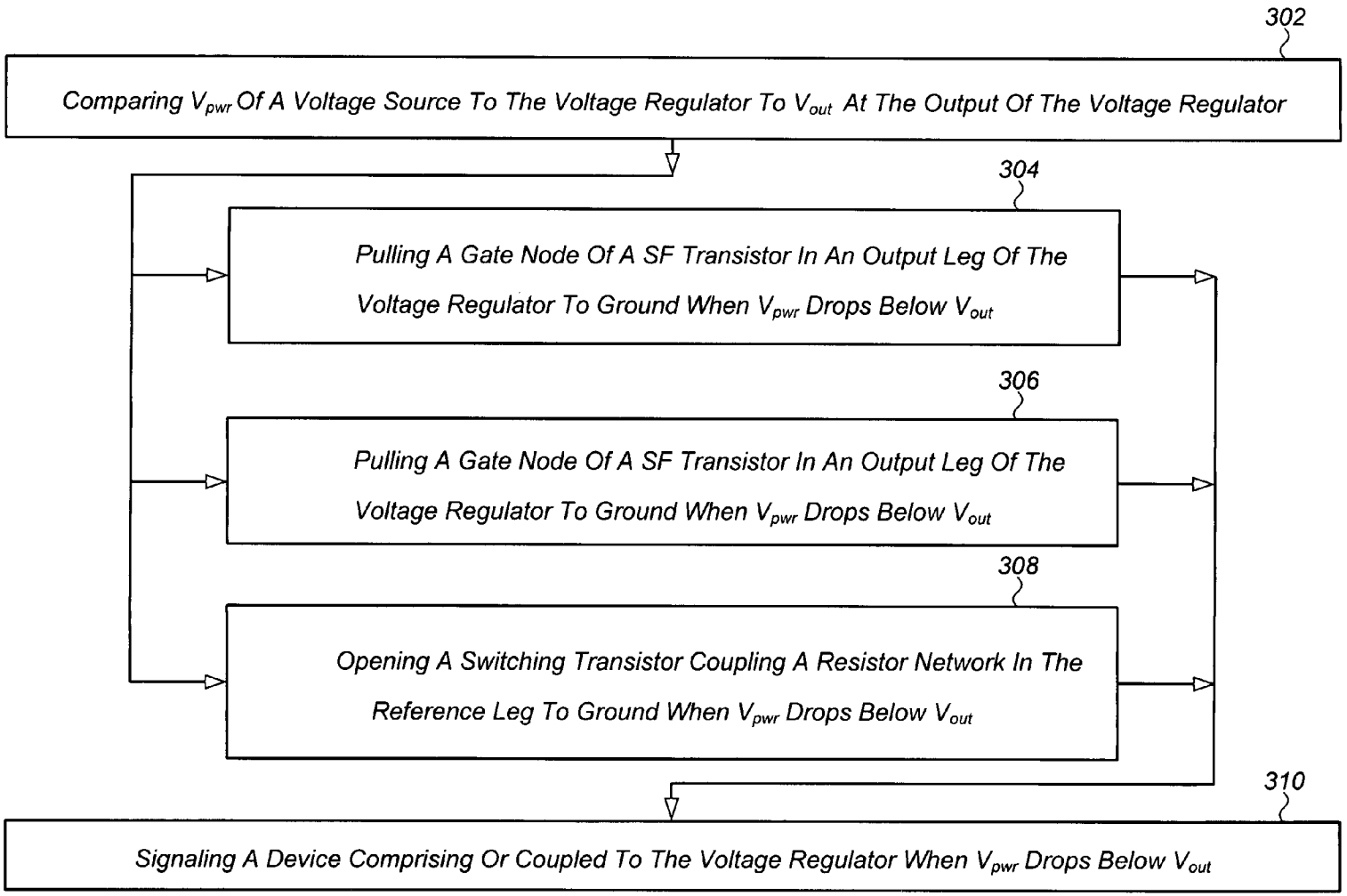
FIG. 3 is a flowchart of a method according to an embodiment of the present invention for operating a voltage regulator to substantially prevent or interrupt reverse current flow into the voltage regulator from an output thereof.

A method or sequence of operating the circuit of FIG. 2 according to an embodiment of the present invention will now be described with reference to FIG. 3. FIG. 3 is a flowchart of a method according to an embodiment of the present invention for operating a voltage regulator to interrupt current flow into the voltage regulator from an output thereof. The method begins with comparing $V_{pwr}$ of a voltage source coupled to the voltage regulator to $V_{out}$ at the output of the voltage regulator (step 302). Next, a leaker transistor is controlled or operated to couple or pull a gate node of a first SF transistor in an output leg of the voltage regulator to a circuit ground when $V_{pwr}$ drops below $V_{out}$ (step 304). The leaker transistor is also operated to pull a gate node of a second SF transistor in a reference leg of the voltage regulator to circuit ground when $V_{pwr}$ drops below $V_{out}$ (step 306). A switching transistor is operated to open a current path coupling the reference leg to circuit ground when $V_{pwr}$ drops below $V_{out}$ (step 308). As indicated by the flowchart of FIG. 3 the steps of pulling gate nodes of the first and second SF transistors to ground, step 304 and 306 respectively, and operating the switching transistor, step 308, are performed at substantially the same time. In certain embodiments, as shown above, the switching transistor is in connected in series with a resistor network in the reference leg.

Optionally or preferably, the method can further include the step of signaling a device comprising or coupled to the voltage regulator when $V_{pwr}$ drops below $V_{out}$ (step 310). More preferably, the signaling step, step 310, is performed at substantially the same time as steps 304, 306 and 308.

The ability of a circuit and method according to the present invention to interrupt or substantially prevent reverse current into a voltage regulator from an output thereof when a power supply voltage drops below an output voltage will now be illustrated with reference to the graphs of FIG. 4. In particular, FIG. 4 includes four separate graphs illustrating exemplary inputs to and outputs from the circuits of FIG. 2. Line 402 in the top graph, labeled $V_{pwr}$ and $V_{out}$ (V), illustrates a voltage of the voltage source ($V_{pwr}$) and line 404 the voltage at the output of the voltage regulator ($V_{out}$). Line 406 in the second graph from the top, labeled Comparator output (V), illustrates a change in the output of the comparator (comparator 220 in FIG. 2) as $V_{pwr}$ drops below $V_{out}$. Line 408 in the third graph, labeled Gate of SF (V), illustrates a voltage to the gate nodes of the first and second source followers (transistors 228 and 230 in FIG. 2). Line 410 in the fourth and final graph, labeled Current (A), illustrates the current flow through the output of the voltage regulator in milliamps (mA).

Figure 4:
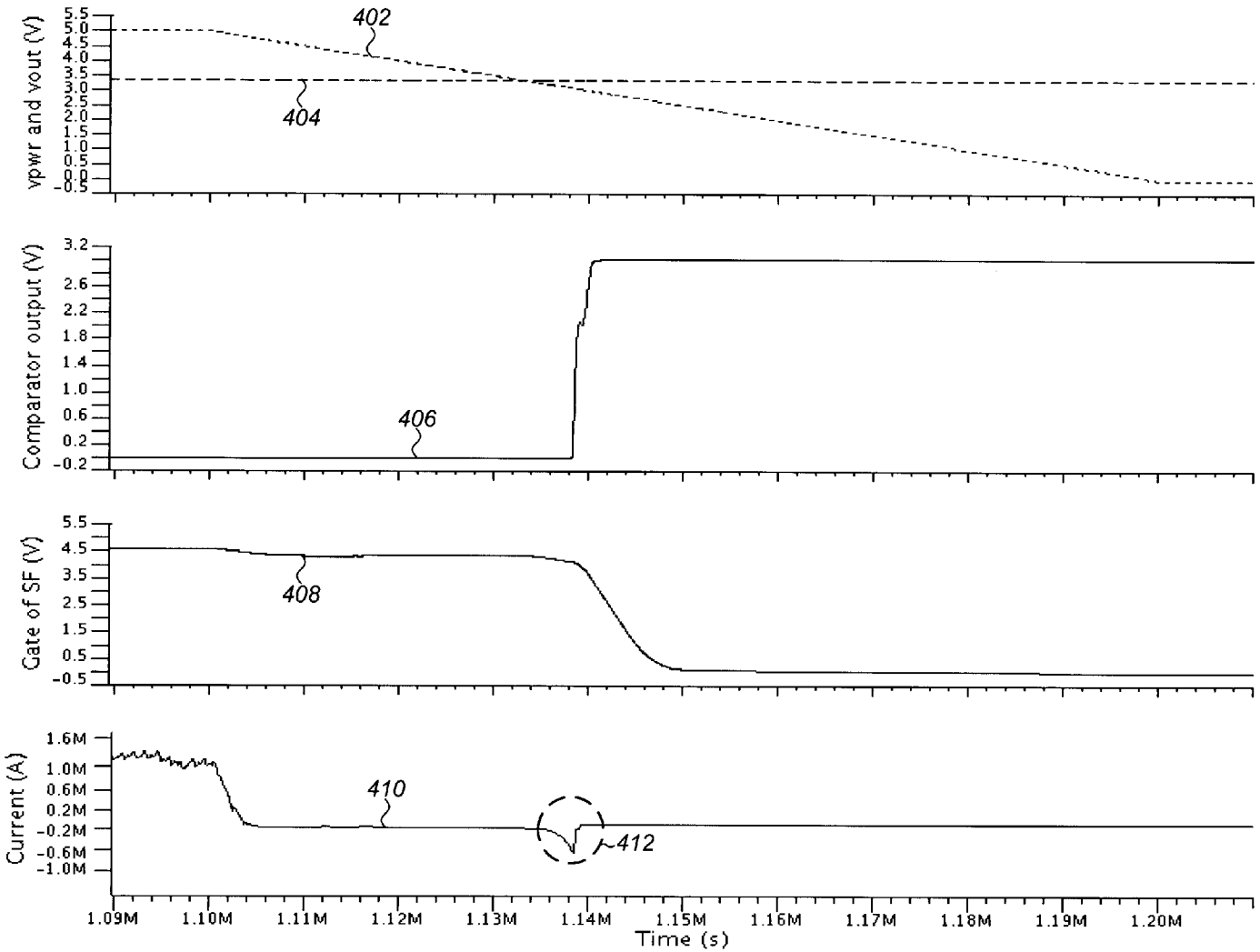
FIG. 4 are graphs illustrating the ability of a circuit according to the present invention to substantially prevent or interrupt reverse current flow into the voltage regulator from an output thereof.

Referring to the graphs of FIG. 4 it seen that initially, at time 1.09 milliseconds (mS), $V_{pwr}$ (line 402) is equal to 5.0 V, the comparator output (line 406) is 0V, the voltage applied to the gate nodes of the first and second source followers (line 408) is equal to about 4.5 V to provide a regulated output voltage $V_{out}$ (line 404) of about 3.3 V and a current out of the voltage regulator of about +1.2 to about +1.4 mA. At about time T equal 1.10 mS $V_{pwr}$ (line 402) begins dropping and current flow out of the voltage regulator (line 410) quickly drops to about 0 mA at time (T) equal 1.105 mS. $V_{pwr}$ (line 402) continues to droop and at about T equal 1.132 mS drops below $V_{out}$ (line 404). Immediately or soon thereafter at about T equal 1.138 mS the comparator output (line 406) goes high to about 3V operating the leaker transistors (transistor 228 in FIG. 2) to couple the gate nodes of the first and second source followers (line 408) to ground. As shown by line 410 in the bottom graph current flow out of the voltage regulator quickly settles at about 0 mA at T 1.14 mS after a brief dip (reverse current flow) indicated by dashed line 412 peaking at less than about −0.6 mA.

The advantages of the circuit and method of the present invention over previous or conventional systems and methods include: (i) interrupting or substantially preventing reverse current flowing into the voltage regulator when $V_{pwr}$ drops below $V_{out}$; (ii) substantially preventing any voltage drop or droop in the output voltage when $V_{pwr}$ drops below $V_{out}$; (iii) ability to signal a device comprising or coupled to the voltage regulator when $V_{pwr}$ drops below $V_{out}$; (iv) increasing battery life time in battery operated devices, such as a wireless computer mouse and other like devices, by interrupting or substantially preventing reverse current flowing into the voltage regulator, which can quickly drain the battery; and (v) having substantially no impact on the performance of the voltage regulator in normal operating mode.

The foregoing description of specific embodiments and examples of the invention have been presented for the purpose of illustration and description, and although the invention has been described and illustrated by certain of the preceding examples, it is not to be construed as being limited thereby. They are not intended to be exhaustive or to limit the invention to the precise forms disclosed, and many modifications, improvements and variations within the scope of the invention are possible in light of the above teaching. It is intended that the scope of the invention encompass the generic area as herein disclosed, and by the claims appended hereto and their equivalents. The scope of the present invention is defined by the claims, which includes known equivalents and unforeseeable equivalents at the time of filing of this application.

What is claimed is:

1. A circuit for interrupting current flow into a voltage regulator from an output of the voltage regulator, the circuit comprising:

a comparator including an output, an input coupled to a voltage source, and an input coupled to the output of the voltage regulator; and a number of transistors coupled to the output of the comparator and controlled thereby, the number of transistors including a first transistor configured to interrupt a first current path extending between the output of the voltage regulator and the voltage source through an output leg of the voltage regulator when a voltage of the voltage source ($V_{pwr}$) drops below a voltage at the output of the voltage regulator ($V_{out}$).

2. A circuit according to claim 1, wherein the voltage regulator is a replica voltage regulator further comprising a reference leg and a feedback circuit coupling $V_{out}$ to the reference leg, and wherein the first transistor is further configured to interrupt a second current path extending between the output of the voltage regulator and the voltage source through the feedback circuit and at least partially through reference leg when $V_{pwr}$ drops below $V_{out}$.

3. A circuit according to claim 2, wherein the output leg comprises a first source follower (SF) transistor in the first current path, and wherein the first transistor is a leaker transistor configured to pull a gate node of the first SF transistor to a circuit ground when $V_{pwr}$ drops below $V_{out}$.

4. A circuit according to claim 3, wherein the reference leg comprises a second SF transistor in the second current path, and wherein the first transistor is further configured to pull a gate node of the second SF transistor to circuit ground when $V_{pwr}$ drops below $V_{out}$.

5. A circuit according to claim 4, wherein the reference leg further comprises a resistor network through which a source of the second SF transistor and the feedback circuit is coupled to circuit ground, and wherein the number of transistors include a second transistor configured to interrupt a third current path extending between the output of the voltage regulator and circuit ground through the feedback circuit and the resistor network when $V_{pwr}$ drops below $V_{out}$.

6. A circuit according to claim 1, wherein the comparator is configured to signal a device comprising or coupled to the voltage regulator when $V_{pwr}$ drops below $V_{out}$.

7. A circuit according to claim 1, wherein the comparator is powered by the output of the voltage regulator ($V_{out}$).

8. A method for interrupting current flow into a voltage regulator from an output thereof, the method comprising steps of:

comparing a voltage ($V_{pwr}$) of a voltage source coupled to the voltage regulator to a voltage ($V_{out}$) at the output of the voltage regulator; and controlling a number of transistors to substantially prevent current flowing from the output of the voltage regulator into the voltage regulator when $V_{pwr}$ drops below $V_{out}$.

9. A method according to claim 8, wherein the voltage regulator is a replica voltage regulator comprising a reference leg and an output leg, and wherein the method comprises the step of interrupting a first current path extending between the output of the voltage regulator and the voltage source through an output leg of the voltage regulator when $V_{pwr}$ drops below $V_{out}$.

10. A method according to claim 9, wherein the voltage regulator further comprises a feedback circuit coupling $V_{out}$ to the reference leg, and wherein the method further comprises the step of interrupting a second current path extending between the output of the voltage regulator and the voltage source through the feedback circuit and at least partially through reference leg when $V_{pwr}$ drops below $V_{out}$.

11. A method according to claim 10, wherein the output leg comprises a first source follower (SF) transistor in the first current path and the reference leg comprises a second SF transistor in the first current path, and wherein the steps of interrupting the first and second current paths comprise the steps of pulling gate nodes of the first and second SF transistors to a circuit ground when $V_{pwr}$ drops below $V_{out}$.

12. A method according to claim 11, wherein the reference leg further comprises a resistor network through which a source of the second SF transistor and the feedback circuit is coupled to circuit ground, and wherein the method further comprises the step of interrupting a third current path extending between the output of the voltage regulator and circuit ground through the feedback circuit and the resistor network when $V_{pwr}$ drops below $V_{out}$.

13. A method according to claim 8, further including the step of signaling a device comprising or coupled to the voltage regulator when $V_{pwr}$ drops below $V_{out}$.

14. A voltage regulator comprising:

a comparator including an output, a non-inverting input coupled to a voltage source and an inverting input coupled to an output of the voltage regulator; and a number of transistors coupled to the output of the comparator and controlled thereby to substantially prevent current from flowing from the output of the voltage regulator into the voltage regulator when a voltage of a voltage source ($V_{pwr}$) of the voltage regulator drops below a voltage at the output of the voltage regulator ($V_{out}$).

15. A voltage regulator according to claim 14, wherein the voltage regulator is a replica voltage regulator comprising a reference leg and an output leg, and wherein the number of transistors include a first transistor configured to interrupt a first current path extending between the output of the voltage regulator and the voltage source through an output leg of the voltage regulator when $V_{pwr}$ drops below $V_{out}$.

16. A voltage regulator according to claim 15, wherein the voltage regulator further comprises a feedback circuit coupling $V_{out}$ to the reference leg, and wherein the first transistor is further configured to interrupt a second current path extending between the output of the voltage regulator and the voltage source through the feedback circuit and at least partially through reference leg when $V_{pwr}$ drops below $V_{out}$.

17. A voltage regulator according to claim 16, wherein the output leg comprises a first source follower (SF) transistor in the first current path, and wherein the first transistor is a leaker transistor configured to pull a gate node of the first SF transistor to a circuit ground when $V_{pwr}$ drops below $V_{out}$.

18. A voltage regulator according to claim 17, wherein the reference leg comprises a second SF transistor in the second current path, and wherein the first transistor is further configured to pull a gate node of the second SF transistor to circuit ground when $V_{pwr}$ drops below $V_{out}$.

19. A voltage regulator according to claim 18, wherein the reference leg further comprises a resistor network through which the feedback circuit coupling $V_{out}$ to the reference leg is coupled to electrical ground, and wherein the number of transistors include a second transistor configured to interrupt a third current path extending between the output of the voltage regulator and circuit ground through the feedback circuit and the resistor network when $V_{pwr}$ drops below $V_{out}$.

20. A voltage regulator according to claim 13, wherein the comparator is configured to signal a device comprising or coupled to the voltage regulator when $V_{pwr}$ drops below $V_{out}$.

* * * * *